US008915083B2

(12) United States Patent
McMillan

(10) Patent No.: US 8,915,083 B2
(45) Date of Patent: Dec. 23, 2014

(54) VAPOR POWERED ENGINE/ELECTRIC GENERATOR

(76) Inventor: George Erik McMillan, Hickory, NC (US)

( * ) Notice: Subject to any disclaimer, the term of this patent is extended or adjusted under 35 U.S.C. 154(b) by 987 days.

(21) Appl. No.: 12/579,029

(22) Filed: Oct. 14, 2009

(65) Prior Publication Data

US 2010/0095674 A1 Apr. 22, 2010

Related U.S. Application Data

(60) Provisional application No. 61/105,162, filed on Oct. 14, 2008, provisional application No. 61/185,486, filed on Jun. 6, 2009.

(51) Int. Cl.
*F01K 25/10* (2006.01)

(52) U.S. Cl.
CPC ..... *F01K 25/10* (2013.01)
USPC ..... 60/641.1

(58) Field of Classification Search
USPC ..... 60/641.1–641.15, 651, 671
See application file for complete search history.

(56) References Cited

U.S. PATENT DOCUMENTS 4,995,234 A 2/1991 Kooy et al.
2004/0255591 A1 * 12/2004 Hisanaga et al. ..... 60/772
2005/0166607 A1 8/2005 Brasz et al.
2006/0010872 A1 1/2006 Singh et al.
2007/0007771 A1 * 1/2007 Biddle et al. ..... 290/7
2010/0194111 A1 * 8/2010 Van Den Bossche et al. .... 290/2
2011/0041492 A1 * 2/2011 Maguire ..... 60/520

FOREIGN PATENT DOCUMENTS

WO WO 2007/132183 A2 11/2007
WO WO 2008/074637 A1 6/2008

OTHER PUBLICATIONS

International Search Report and Written Opinion for International Application No. PCT/US2009/060658, mailed Jun. 17, 2011.

* cited by examiner

*Primary Examiner* — Kenneth Bomberg
*Assistant Examiner* — Jonathan Matthias
(74) *Attorney, Agent, or Firm* — Alston & Bird LLP

(57) ABSTRACT

The present invention provides a vapor powered apparatus for generating electric power. Embodiments of the present invention include a storage tank containing a working fluid having a boiling point less than 160° F., a heating source that vaporizes at least a portion of the working fluid to provide a working pressure of the vaporized working fluid, and a pressure motor that converts the working pressure of the vaporized working fluid into mechanical motion. The vaporized working fluid exiting the pressure motor is captured, condensed and returned to the storage tank. Preferably, at least some of the components of the apparatus are hermetically sealed by an outer casing.

23 Claims, 7 Drawing Sheets

VAPOR POWERED ENGINE/ELECTRIC GENERATOR

CROSS REFERENCE TO RELATED APPLICATIONS

This application is related to commonly owned copending U.S. Provisional Application Ser. Nos. 61/105,162, filed Oct. 14, 2008, and 61/185,486, filed on Jun. 6, 2009, and claims the benefit of their earlier filing dates under 35 U.S.C. 119(e). The contents of U.S. Provisional Application Ser. Nos. 61/105,162 and 61/185,486 are incorporated herein by reference in their entirety.

BACKGROUND OF THE DISCLOSURE

The present invention relates generally to a vapor powered engine/electrical generator. More particularly, the present invention relates to the use of an engineered liquid having a low vaporization temperature as a working fluid in a vapor powered apparatus.

Rankine cycle machines are the most commonly found heat engines found in power generation plants. Such machines use water as a working fluid to drive turbines that are mechanically connected to power generators to provide electricity. Common heat sources utilized for vaporizing the water to produce steam for driving the turbine include the combustion of coal, natural gases, oil, and nuclear fission.

One drawback related to Rankine cycle systems is that the efficiency of the steam turbine is limited by water droplet formation due to condensation of the steam on the turbine blades. Typically, this problem is overcome by superheating the steam to minimize the likelihood of condensation of steam on or through the turbine. However, this approach undesirably requires an additional heat demand to superheat the steam.

Another undesirably feature of Rankine cycle systems is that such systems require large heat sources (in mass and temperature) to vaporize enough water to provide a suitable working pressure to turn the blades of a turbine and ultimately provide power. For instance such systems cannot operate off of a heat source with a low temperature (e.g., generally below 160 degrees Fahrenheit). The operational temperatures of Rankine cycle machines are dangerous and can severely burn humans (e.g., human skin).

As such, there remains a need for an efficient vapor powered apparatus and/or system for providing electric power. Additionally, there remains a need for a vapor powered apparatus and/or system that can generate electric power from low heat sources. Similarly, there remains a need for a vapor powered engine/generator that can operate and lower operation temperatures to reduce dangers to humans, animals and/or the environment.

BRIEF DESCRIPTION OF THE DISCLOSURE

The present invention satisfies at least some of the aforementioned needs by providing a vapor powered apparatus for generating electric power. In certain embodiments, the apparatus includes a storage tank that contains a working fluid having a boiling point less than 160° F. The working fluid is conveyed to a heating source that vaporizes at least a portion of the working fluid to provide a working pressure of the vaporized working fluid. That is, the pressure of the vaporized working fluid is sufficient to drive a pressure motor (e.g., turbine). The pressure motor converts the working pressure of the vaporized working fluid into mechanical motion. The pressure motor is preferably coupled to a generator or alternator to generate electric power. The working fluid vapors that pass through the pressure motor are captured and condensed to provide a re-liquefied working fluid that is returned back to the storage tank for further use.

In another aspect, the present invention provides a vapor powered apparatus for generating electric power in which one or more of the components of the apparatus are disposed within a hermetically sealed casing. In certain embodiments, the apparatus includes a liquid storage section containing a working fluid in liquid form. The working fluid, according to embodiments of the present invention, has a boiling point less than 160° F. The apparatus also includes a vapor section in operative communication with the said liquid storage section. The vapor and liquid sections can be in communication via one or more primary orifices such that any vapors that condense in the vapor section can pass through the primary orifices into the storage section. The vapor section includes a subsection comprising a working fluid vapor condensing section. The working fluid vapor condensing section is proximately positioned to the storage section and includes one or more conduits in fluid communication with the working fluid located in the storage section such that the working fluid in the storage section can be transferred through the inside of the one or more conduits. The apparatus according to such embodiments also includes a primary heat exchanger for vaporizing at least a portion of the working fluid to provide a working pressure of the vaporized working fluid to drive a pressure motor in fluid communication with said primary heat exchanger. The pressure motor converts the working pressure of the vaporized working fluid into mechanical motion. The vaporized working fluid exits from the pressure motor into the vapor section and condenses on the outside surfaces of the conduits having working fluid from the storage section conveyed therein to provide re-liquefied working fluid. The re-liquefied working fluid passes though the primary orifice(s) and into the liquid storage section for further use. Preferably each of the components of the apparatus are disposed within the hermetically sealed casing.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DISCLOSURE

Figure 1:
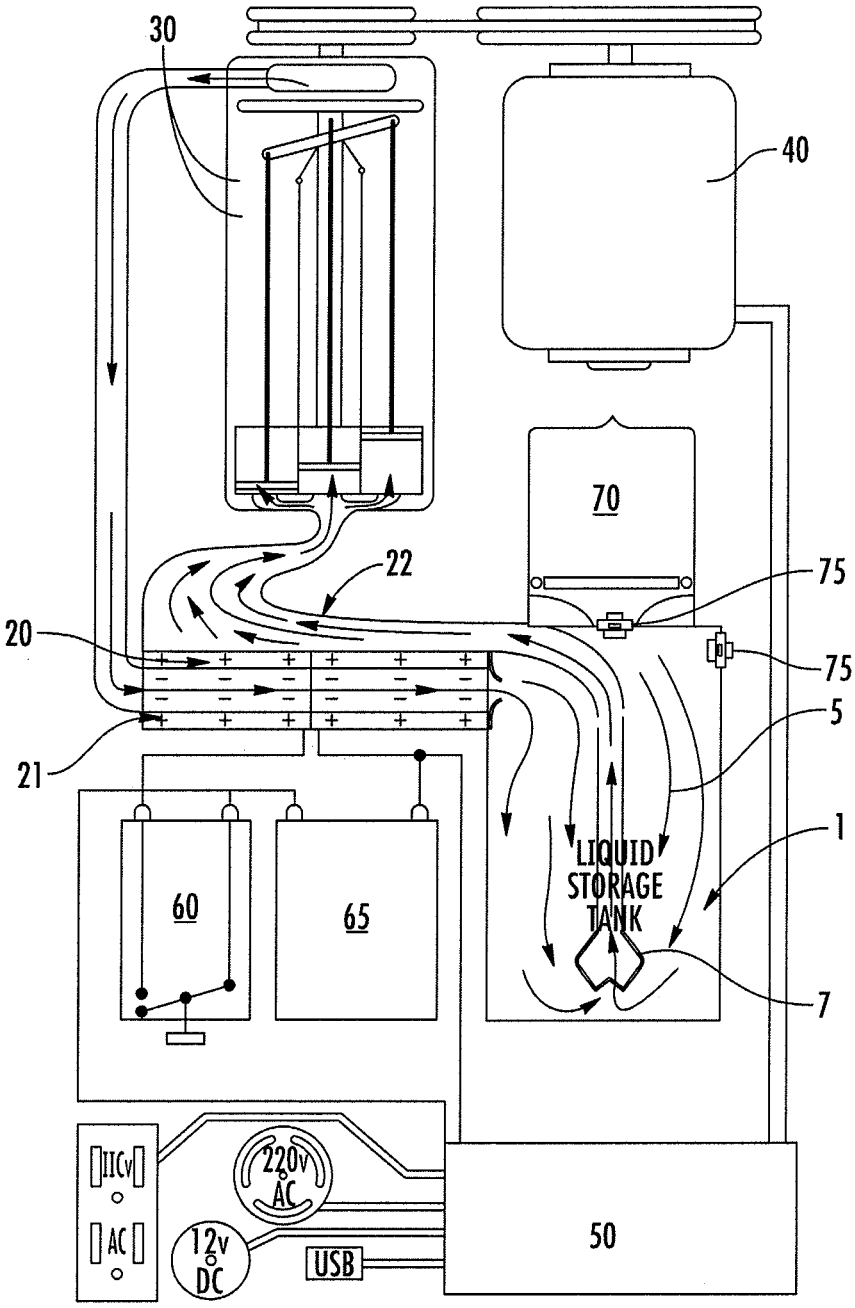
FIG. 1 illustrates an apparatus according to one embodiment of the present invention.

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

Embodiments of the present invention utilize an engineered working fluid that has a low vaporization temperature (i.e., boiling point). Generally speaking, these engineered working fluids have boiling points lower than water (e.g., the engineered working fluid can boil/vaporize at around 90° F. at 1 atmosphere and freeze around −200° F.). One class of engineered liquids that are particularly useful in embodiments of the present invention belong to the C-6 Fluoroketone group. Such liquids, that are suitable for embodiments of the present invention, are commercially available from 3M™ Corporation under the trademark names NOVEC™1230 and NOVEC™ 7000. In certain embodiments, the engineered working fluid according to embodiments of the present invention can, for example only, include Methoxy-nonafluorobutane (e.g., $CF_3CF_2C(O)CF(CF_3)_2$) and/or Dodecafluoro-2-methylpentan-3-one). Another suitable fluid for use as the working fluid according to certain embodiments of the present invention includes Novec 649 available from 3M™ Corporation. Preferably, the working fluid according to embodiment of the present invention also has a liquid density/specific gravity greater than that of water. According to certain embodiments, for instance, the engineered working fluid can have a liquid specific gravity (with Ref Std: Water=1) from 1.1 to 2.0, 1.2 to 1.8, 1.3 to 1.8, 1.3 to 1.7, or from 1.4 to 1.6. The present invention, however, is not limited to these specific chemicals. It would be possible to substitute other similar chemical formulas or different chemical formulas, having similar functional properties in the vapor engine/generator according to embodiments of the present invention.

In certain embodiments, for instance, the working fluid can have a boiling point less than 160° F., 150° F., 140° F., 130° F., 120° F., 110° F., or 100° F. In other embodiments, the working fluid has a boiling point from about 90° F. to about 150° F., about 90° F. to about 120° F., or about 90° F. to about 150° F. In one preferred embodiment, the working fluid has a boiling point from about 90° F. to about 95° F.

Embodiments of the present invention incorporate these engineered chemicals to be utilized as the working fluid to drive a pressure motor (e.g., turbine engine) which, in turn, drives an electrical generator. The engineered working fluid is created or selected to have a low vaporization temperature and preferably is denser than water as discussed above (e.g., a specific gravity from 1.1 to 2.0). These properties allow for use of far less energy to vaporize the working fluid and, with its ability to revert back to liquid form very quickly, it creates vapor pressure and electrical power much more efficiently, effectively, and with far less energy expended than conventional ways. Beneficially, certain embodiments of the present invention are ideal for generating power for homes, farms, and small community use when utilizing, for example, a solar heater for vaporization of the working fluid. Embodiments utilizing geothermal heat can power small communities, businesses, towns, cities and even larger areas of usage.

For instance, embodiments of the present invention can include or be used in conjunction with solar heaters or with geothermal heat to convert the working fluid to vapor without the use of any combustible fuels. In addition, to waste heat sources of solar and geothermal, embodiments of the present invention can utilize other forms of waste heat such as biological (e.g., algae growth and/or decomposition) and electrical (e.g., resistive) or mechanical sources (e.g., friction). In one embodiment, the waste heat is a byproduct or natural occurrence of another process and is not being created specifically for the purpose of energy generation by the apparatus of the present invention. Waste heat can encompass any heat source exceeding about 90° F. More preferably, waste heat can encompass any heat source above about 93° F. (the approximate boiling point of NOVEC™ 7000), which is a preferred boiling point of the engineered working fluid used in accordance with one embodiment of the present invention.

FIG. 1 illustrates one embodiment according to the present invention. In this embodiment, the vapor powered apparatus for generating electric power includes a storage tank 1 that contains a working fluid in liquid form 5 having a boiling point less than 160° F. The working fluid 5 is conveyed to a heating source 20 (by a pump for example—not shown) encased by a boiler chamber 22. The heating source 20 vaporizes at least a portion of the working fluid to provide a working pressure of the vaporized working fluid. That is the pressure of the vaporized working fluid is sufficient to drive a pressure motor 30 (e.g., turbine). The pressure motor 30 converts the working pressure of the vaporized working fluid into mechanical motion. The pressure motor 30 is preferably coupled to a generator or alternator 40 to generate electric power. A power inversion controller 50 is preferably incorporated to provide availability of a desired voltage outlet. The working fluid vapors that pass through the pressure motor 30 are captured and condensed to provide a re-liquefied working fluid that is returned back to the storage tank 1 for further use.

As also shown in FIG. 1, the working fluid in the liquid storage tank passes through a "primary one way valve" 7 and passes along a tube to the boiler chamber 22. The boiler chamber 22 converts the liquid to a gas by the application of heat from the heat source 20. In FIG. 1, the heat source is the hot side of a Peltier effects thermal plate. Additionally, the apparatus can include an on/off switch 60 and a power supply 65 for start-up purposes. For added safety, this embodiment includes a piston type relief tank 70 mounted above the storage tank 1 and blow off valves 75 to relieve pressure in cases of an emergency.

The Peltier effects thermal plate illustrated in FIG. 1 is energized by the start-up power supply 65 such as a battery or capacitor, during the start-up reaction phase, to begin a cycle, to produce the necessary heat to vaporize the working fluid. The vaporized working fluid is led to the pressure motor (e.g., as a piston, turbine or rotary type engine). In FIG. 1, the pressure motor (e.g., vapor engine) drives an electric generator or an alternator 40. The electric generator or alternator 40 both recharges the start-up power supply unit 65 and creates enough electricity to operate additional electrical equipment. Of course, the mechanical motion of the vapor engine may also be used to power other equipment besides a generator/alternator, such as a vehicular drive wheel, cutting tool, water pump, etc.

The vaporized working fluid exiting the pressure motor is routed back to the cold side of the Peltier plate 21. The cold side of the Peltier plate 21 re-condenses the vapor back to liquid form and directs the liquid back into the liquid storage tank. This completes the cycle, which is continually repeated during the process of operating the apparatus.

Although FIG. 1 has labeled the storage tank as a "liquid" storage tank, it should be appreciated that the vapor powered apparatus could function with the storage tank storing low pressure vapor, rather than liquid. For example, the storage tank would store vapor at a first pressure P1. The hot plate side of the Peltier plate could heat the vapor to increase the vapor's pressure to P2. At pressure P2, the vapor would power the pressure motor. The vapor exiting the pressure motor would then be recycled past the cold side of the Peltier plate to reduce the pressure of the vapor back to about pressure P1. Then, the cooled vapor would be returned to the storage tank.

This particular system incorporates chemical and electric technologies along with surrounding ambient temperature to create a sustained reaction. The sustained reaction continuously and very efficiently creates more energy than the fuel required to generate the useable electricity.

Although FIG. 1 shows a Peltier plate and a boiler chamber for the vaporization of the working fluid, the apparatus according embodiments of the present invention can include any commercially available heat exchanger using a variety of transfer fluids passing therethrough to transfer heat to the working fluid such that a portion of the working fluid is vaporized. For instance, in certain embodiments ambient air is used as the transfer fluid for vaporizing at least a portion of the working fluid. In such embodiments, the temperature of the ambient air (i.e., the transfer fluid) is greater than the boiling point of the working fluid. That is, the fresh incoming ambient air has a temperature greater than then boiling point of the working fluid. In other embodiments, the transfer fluid can include a portion of ambient air and any other suitable vapors that are provided at a suitable temperature.

In particular embodiments, the apparatus includes a heat exchanger using a transfer fluid having a temperature of about 90° F. or greater for providing the heat to vaporize at least a portion of the working fluid. Again, the temperature of the incoming transfer fluid is greater than the boiling point of the working fluid. In other embodiments, the transfer fluid for providing the heat to vaporize the working fluid has a temperature from 90° F. to 150° F., from 93° F. to 150° F., from 100° F. to 140° F., or from 90° F. to 100° F. The power source/heat source that is used the transfer fluid in the heat exchanger to vaporize the working fluid can comprise waste heat from a separate power source. Common examples of equipment producing waste heat are incinerators, boilers and cookers. Power companies (e.g., coal, nuclear, hydro-electric) typically have equipment which produces mechanical and electrical waste heat (e.g., transformers, turbine shafts, generators on a hydroelectric dam, cooling water baths for nuclear power plants).

Apparatuses' according to certain embodiments can function with waste heat sources as low as about 93° F., which greatly expands the potential sources from which to acquire waste heat. In certain embodiments, for example, heat sources between the temperatures of about 93° F. and about 160° F. work well. Although the system will also function well with heat sources exceeding 160° F., the potential employment opportunity is greatly expanded when the universe of waste heat sources includes heat sources having a temperature of less than about 160° F., more preferably less than about 150° F., most preferably less than about 140° F.

For instance, in some areas (e.g., dessert, rainforest), the ambient temperature consistently exceeds 93° F. for extended periods of time. Such ambient temperatures are sufficient to exceed the boiling point of the working fluid employed according to embodiments of the present invention. If a source of natural cooling is also present (e.g., a river/stream, geothermal depths) to bring the working fluid back to a liquid state (or lower gaseous pressure, as described above), the embodiments of the present invention can utilize the temperature differential within the local environment as the heating/cooling sources to produce power.

The converse is also true, in some areas, there are natural heat sources (e.g., volcanic, hot baths, steam vents) which consistently exceeds 93° F. for extended periods of time. If a source of natural cooling is also present (e.g., the environmental air, a river/stream, geothermal depths) to bring the working fluid according to embodiments of the present invention to a liquid state (or lower gaseous pressure, as described above), such embodiments can utilize the temperature differential within the local environment as the heating/cooling sources to produce power.

Beneficially, embodiments of the present invention create absolutely no hydrocarbons, nor require any special storage for depleted power sources, such as Uranium or Carbon waste. Systems according to embodiments of the present invention do not use CFC producing materials or Freon, which are hazardous and/or ozone depleting. Additionally, toxic, caustic, flammable, combustible or dangerous chemicals (e.g., ammonias, solvents or gaseous fuels—propane, butane or toluene) can be avoided according to embodiments of the present invention.

Figure 2:
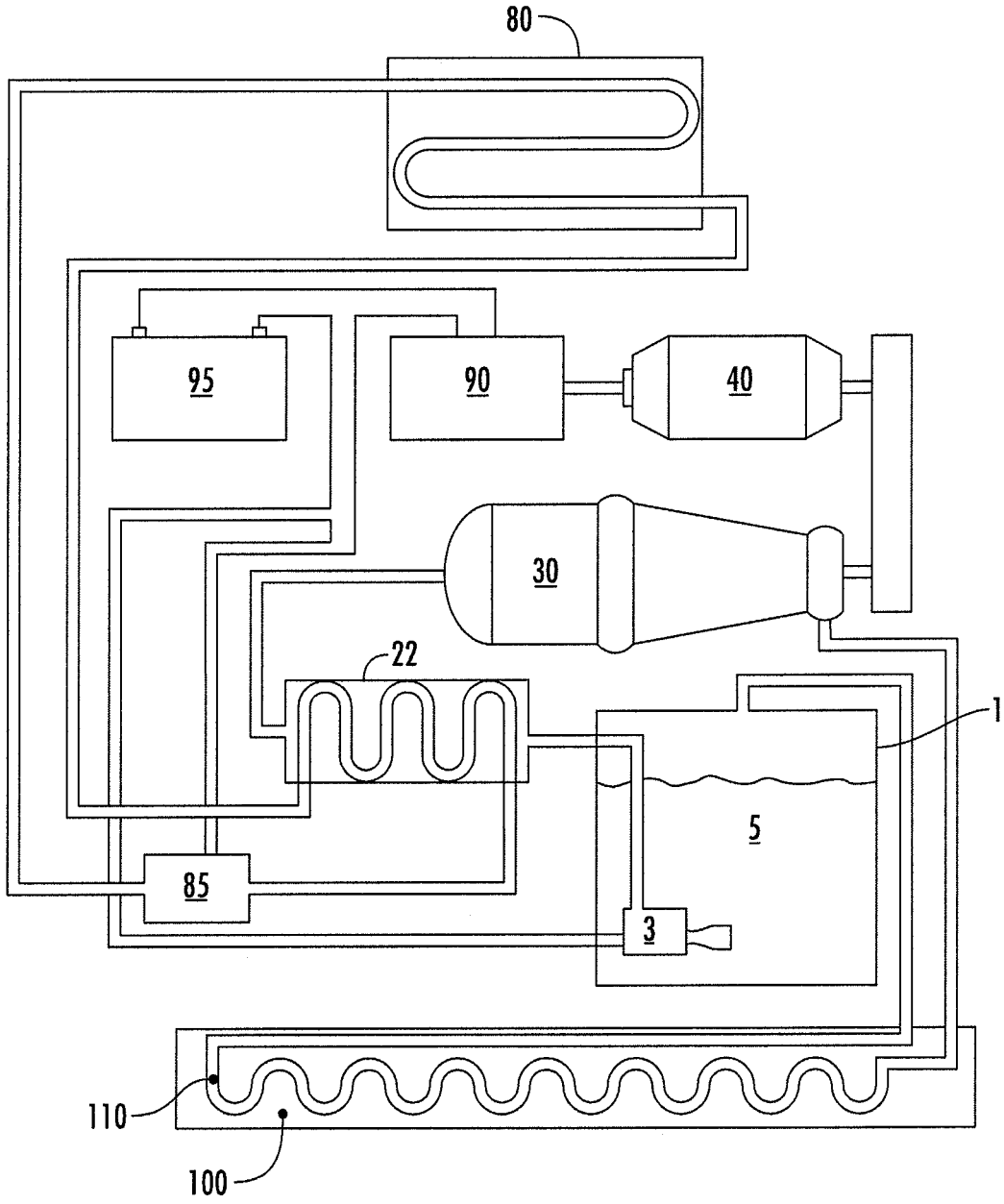
FIG. 2 illustrates an apparatus according to one embodiment of the present invention including a solar heater for heating transfer fluid and a sub-terranian or submersed cooling system for re-liquefication of the working fluid.
Figure 3:
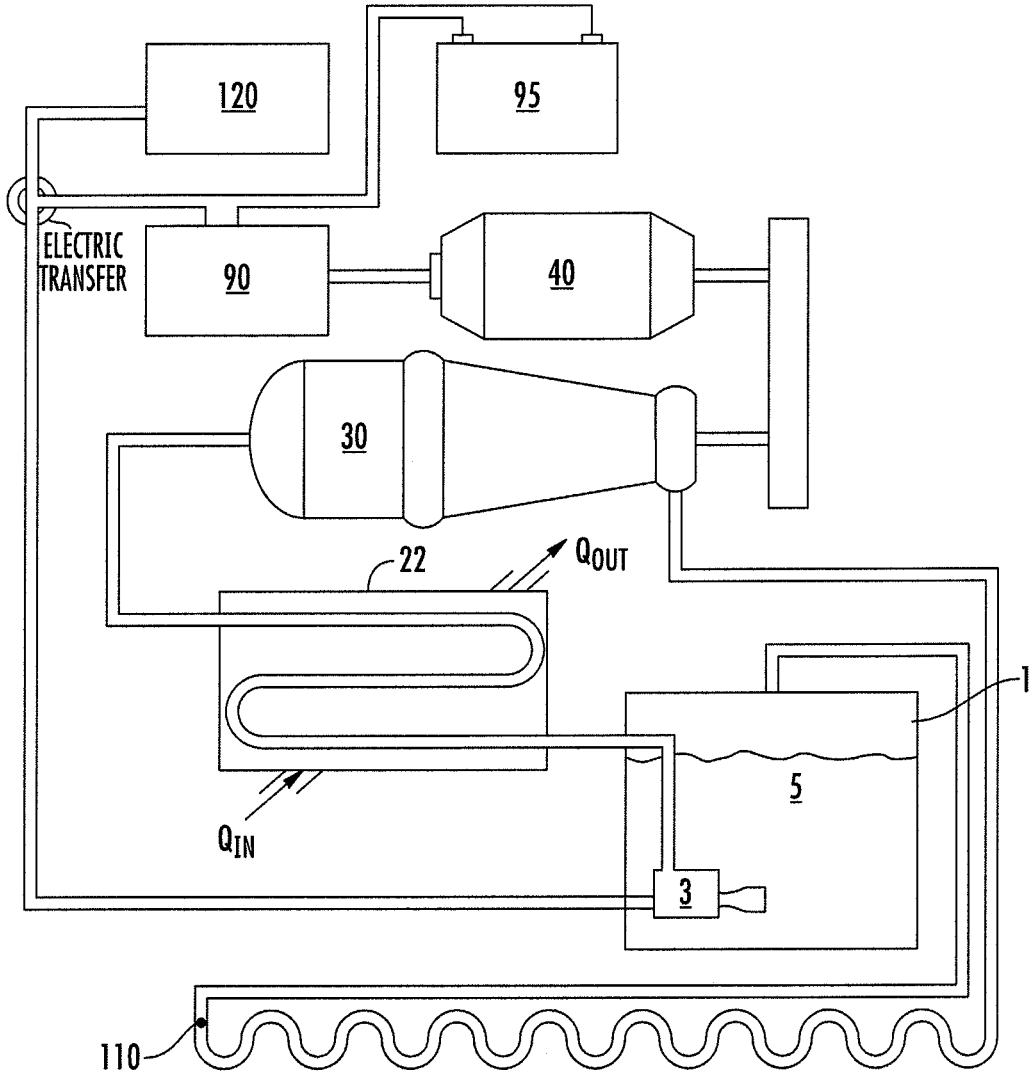
FIG. 3 illustrates another embodiment according to the present invention, in which the apparatus includes a solar cell panel that provides power to the working fluid pump and a sub-terrain cooling system.

As illustrated in FIGS. 2-3, embodiments of the present invention can include or be used with a subterranean or submersed reconstitution system, wherein the vaporized working fluid is forced through the subterranean or submersed reconstitution system where it is converted back to liquid form. Since only about 77° F. is required, according to one embodiment, to quickly convert the vaporized working fluid back to a liquid, this enables the complete generating system to be utilized as a readily available power source, which is free in cost to operate and efficient and most of all, consistent.

FIG. 2 illustrate an apparatus according to one embodiment of the present invention including a solar heater 80 for heating transfer fluid and a subterranean or submersed cooling system 110 comprising a thermal transfer tank 100 filled with transfer fluid (for re-liquefication) of the working fluid. Similarly, FIG. 3 illustrates the incorporation of a solar cell panel 120. FIGS. 2-3 each illustrate embodiments in which the working fluid 5 is held in a storage tank 1 and transferred by a pump 3 to heat exchanger 22 where the working fluid is at least partially vaporized. The vaporized working fluid drives the pressure motor 30, which is mechanically connected to a generator or alternator 40 to produce electric energy. In the embodiment illustrated by FIG. 2, an electricity control panel 90 and a start-up battery 95 are included for providing the power needed to operate liquid storage pump 3 and the vaporizing transfer fluid pump 85. In this particular embodiment, a solar heater 80 is provided and supplies the heat necessary for warming up the transfer fluid used in the heat exchanger 22 for vaporizing the working fluid. As such, this embodiment merely requires solar energy to provide the necessary power or heat for operation of the apparatus, and ultimately the generation of electrical power.

Figure 4:
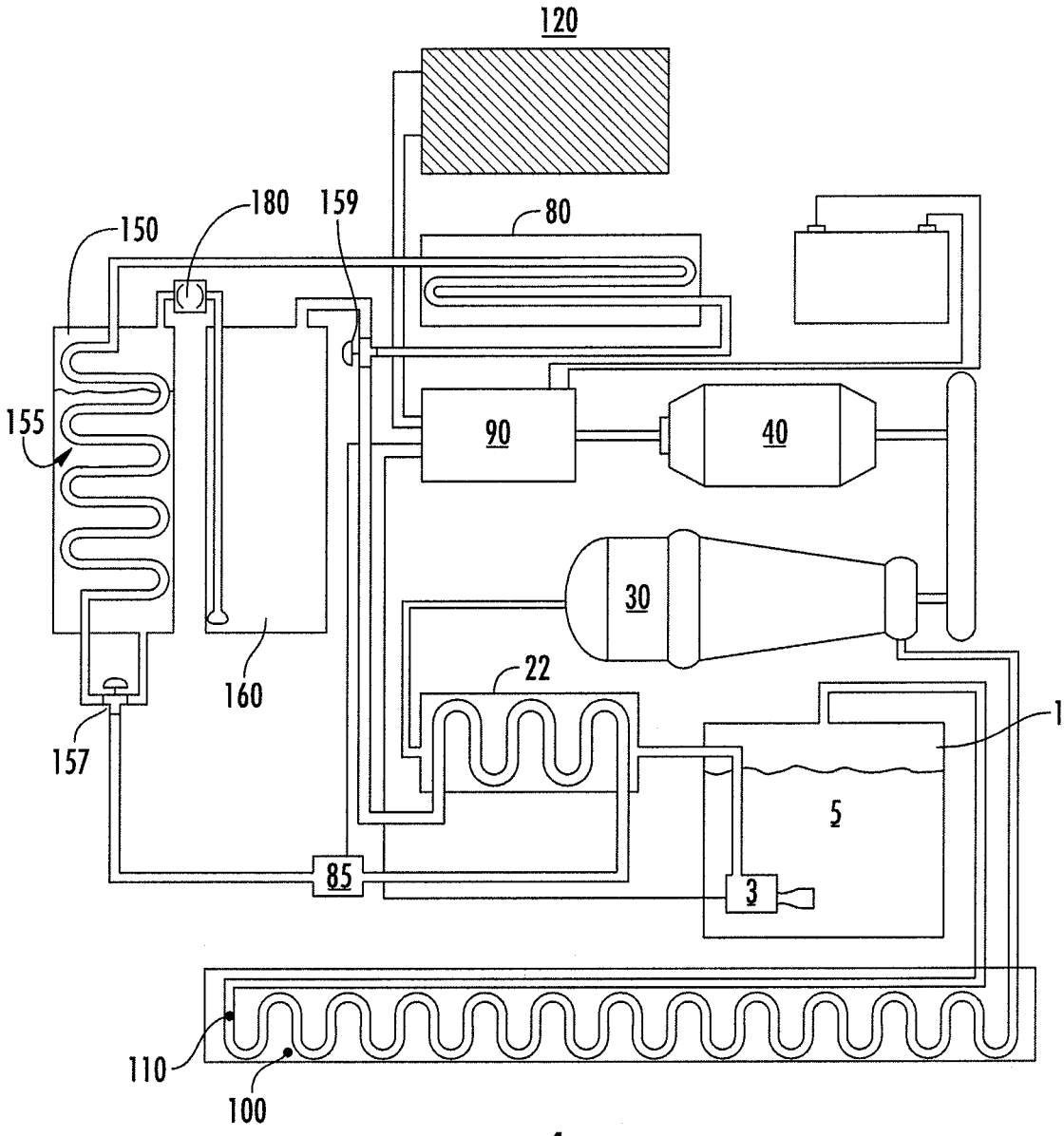
FIG. 4 illustrates another apparatus according to one embodiment of the present invention including a heat transfer hot storage chamber for night operation and a depleted transfer fluid storage chamber.

As illustrated by FIG. 4, certain embodiments according to the present invention can be configured such that transfer pumps 3, 85 can be run on power generated from a solar cell panel 120 while transfer fluid for vaporizing the working fluid can be heated with a solar heater 80. In this particular embodiment, the heated transfer fluid from the solar heater 80 travels through one or more conduits disposed within a heat transfer hot storage chamber 150 to re-heat transfer fluid that was used during night-time operation 155. At the beginning of the day (e.g., daylight) chamber 155 is filled with transfer fluid that has given-up some of its heat to vaporize the working fluid during nighttime hours. Over the course of the day, this transfer fluid 155 is heated in chamber 150 until the next night when the solar heater 80 may not provide enough heat to adequately increase the temperature of the transfer fluid to vaporize the working fluid. In such a case, the apparatus can be switched over by adjusting a valve 157 to utilize the re-heated transfer fluid 155 in chamber 150 until sufficient solar energy is available to switch back. During operation at night or when sufficient solar energy is not available, valve 159 is adjusted such that the spent transfer fluid is transferred to the depleted transfer fluid storage chamber 160. Once sufficient solar power is available to begin heating the transfer fluid with the solar heater 80 again, valves 157 and 159 are adjusted back to their original positioning such that any transfer fluid in chamber 155 is no longer used to vaporize the working fluid but instead is reheated. Additionally, when the apparatus is switched back to using the solar heater 80 transfer valve 180 is opened and any spent or depleted (e.g., cooled) transfer fluid in chamber 160 is transferred into chamber 150 for re-heating over the course of the next operation period.

Figure 5:
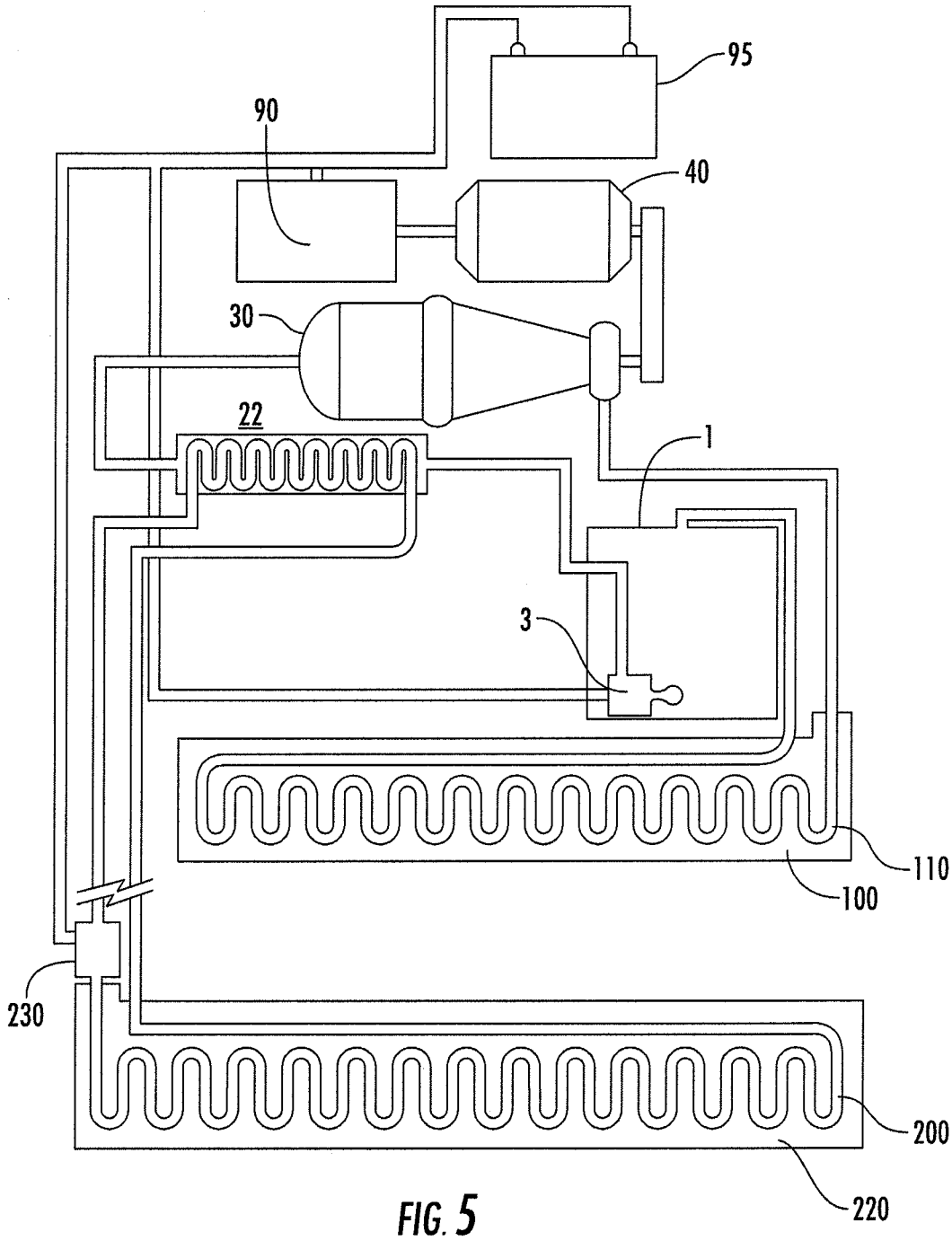
FIG. 5 illustrates another embodiment in which the apparatus includes a geo-thermal heating system.

FIG. 5 illustrates another embodiment in which the apparatus includes a geo-thermal heating system 200 including a thermal transfer tank filled with transfer fluid to heat the transfer fluid sufficiently such that the transfer fluid can vaporize the working fluid in heat exchanger 22. The transfer fluid contained in the geo-thermal heating system is circulated therein by means of pump 230. The geo-thermal heating system uses the geo-thermal energy that originates form the heat retained within the Earth's core. Since embodiments of the present invention require significantly reduced levels of heat/power to operate, the geo-thermal heating system 200 according to these particular embodiments can be located at relatively shallow depths. For instance, the geo-thermal heating system 200 can be located at any depth that sufficiently heats the transfer fluid to a temperature such that after any temperature loss realized during conveying the transfer fluid to the heat exchanger 22, the transfer fluid still has a suitable temperature for vaporizing at least a portion of the working fluid as described herein. Depending on the location of the apparatus, this depth can vary greatly. For instance, the heat realized near fault lines is greatly increased and the depth at which the geo-thermal heating system 200 must be located is substantially reduced.

As can be readily realized, embodiments of the present invention do not require and preferably exclude the use of combustibles, do not emit greenhouse gases, and require little energy to generate electrical power.

Figure 6:
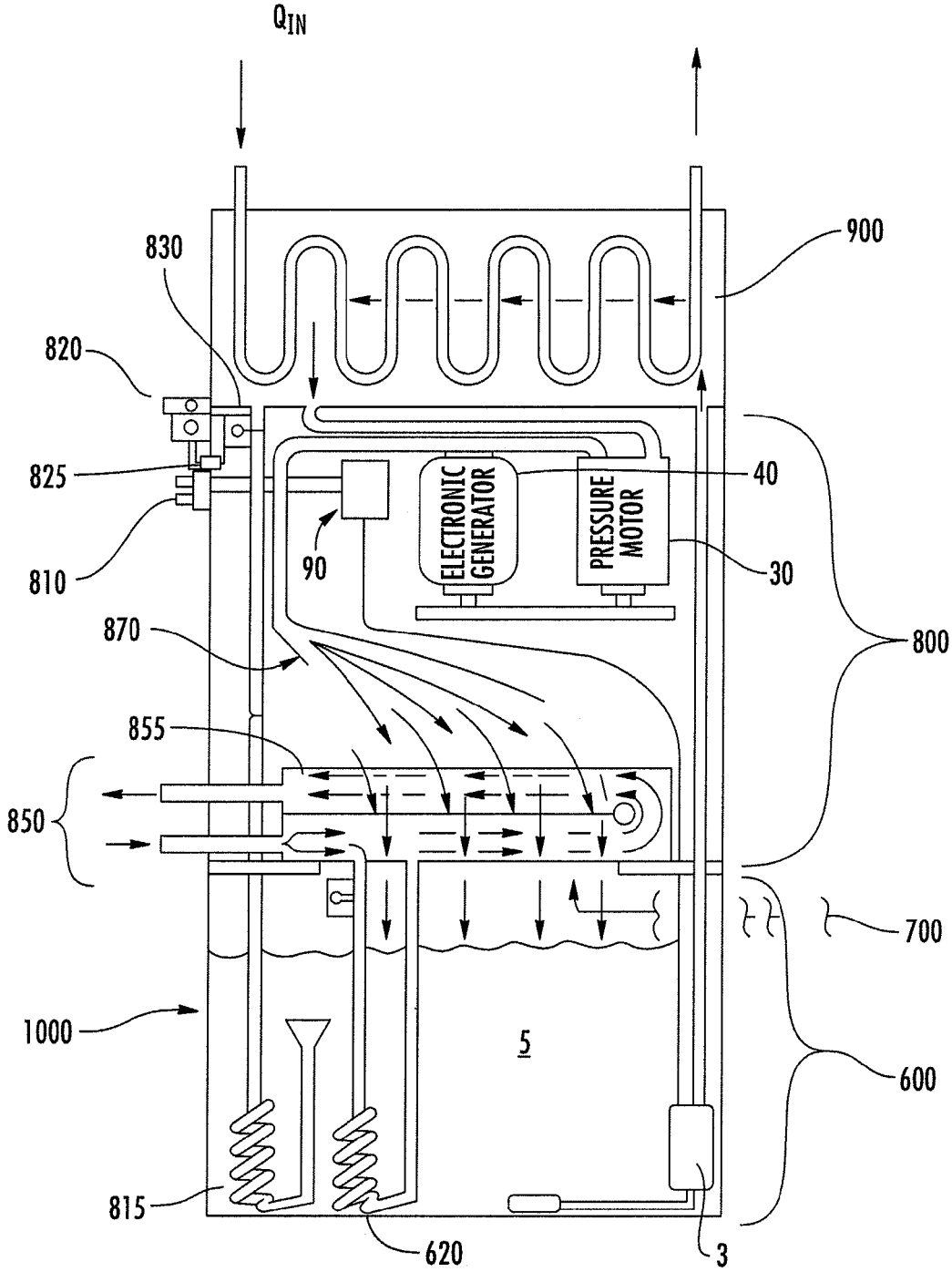
FIG. 6 illustrates an embodiment according to the present invention that includes a hermetically sealed case.
Figure 7:
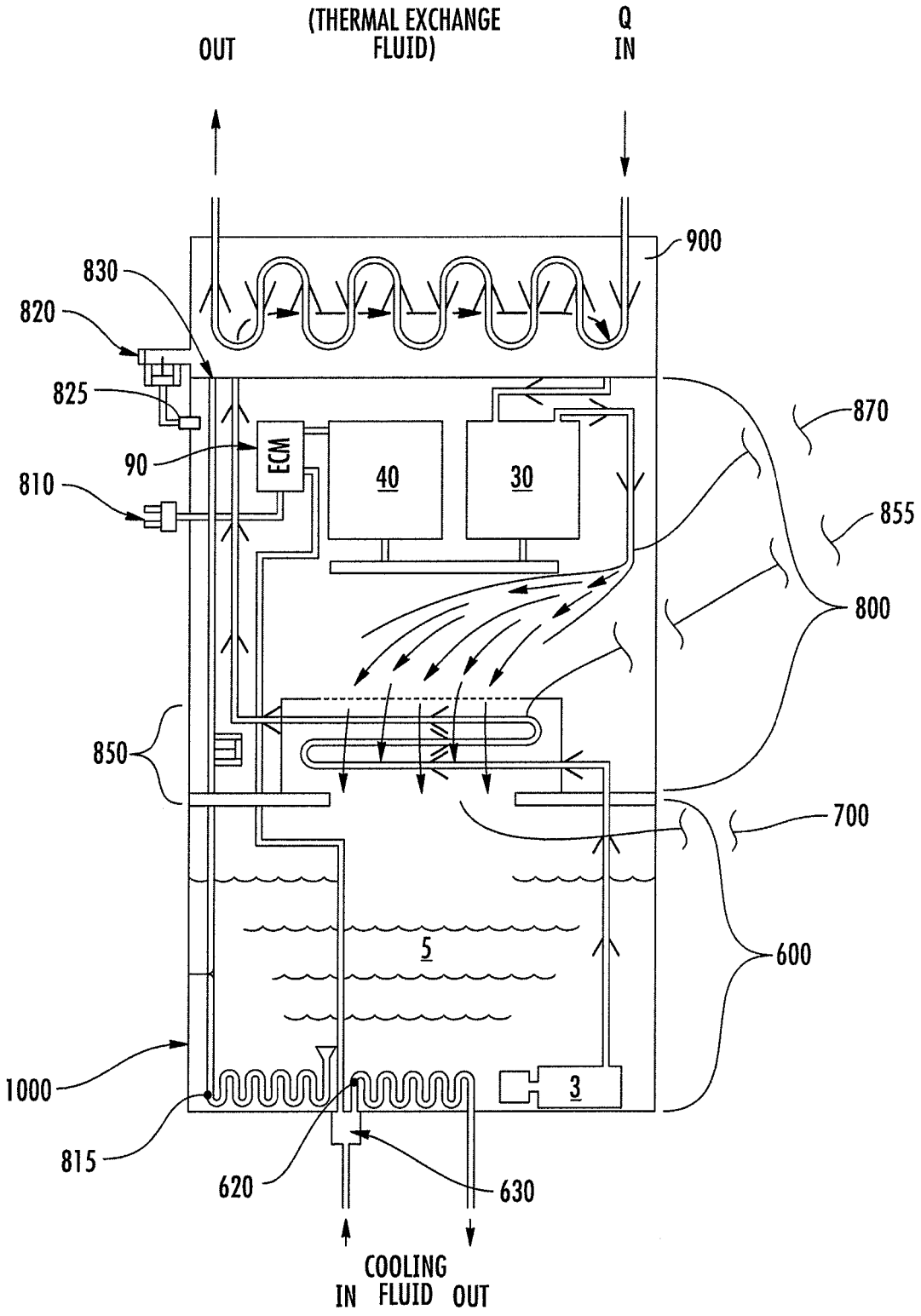
FIG. 7 illustrates an embodiment according to the present invention in which all of the components of the apparatus are positioned within a hermetically sealed case.

In certain preferred embodiments, the present invention provides a vapor powered apparatus for generating electric power in which one or more of the components of the apparatus are disposed within a hermetically sealed casing. As shown in FIGS. 6-7, the apparatus according to certain such embodiments include a liquid storage section 600 containing a working fluid in liquid form 5. The working fluid 5, according to embodiments of the present invention, has a boiling point less than 160° F. The apparatus also includes a vapor section 800 in operative communication with the said liquid storage section 600. The vapor and liquid sections can be in communication via one or more primary orifices 700 such that any vapors that condense in the vapor section 800 can pass through the primary orifices 700 into the liquid storage section 600. The vapor section 800 includes a subsection comprising a working fluid vapor condensing section 850. The working fluid vapor condensing section 850 is proximately positioned to the liquid storage section 600 and includes one or more conduits 855 in fluid communication with the working fluid located in the storage section such that the working fluid in the storage section can be transferred through the inside of the one or more conduits by, for example, pump 3. The apparatus according to such embodiments also includes a primary heat exchanger 900 for vaporizing at least a portion of the working fluid to provide a working pressure of the vaporized working fluid to drive a pressure motor 30 in fluid communication with said primary heat exchanger 900. The pressure motor 30 converts the working pressure of the vaporized working fluid into mechanical motion. The vaporized working fluid exits from the pressure motor 30 into the vapor section 800 and condenses on the outside surfaces of the conduits 855 having working fluid from the storage section conveyed therein to provide re-liquefied working fluid. The re-liquefied working fluid passes though the primary orifice(s) 700 and into the liquid storage section 600 for further use. At least one of the liquid storage section 600, the vapor section 800, the working fluid vapor condensing section 850, the primary heat exchanger 900 and pressure motor 30 are mounted within a hermetically sealed casing 1000. Preferably all of the components of the apparatus are disposed within the hermetically sealed casing 1000.

Also shown in FIGS. 6-7, the pressure motor 30 is operatively connected to a power generator or alternator 40 that converts the mechanical motion into electric power. The pressure motor 30 and power generator or alternator 40 are preferably each mounted within the hermetically sealed casing 1000. Pump 3, as shown in FIGS. 6-7 is submerged within the working liquid 5 being stored in the liquid storage section 600 and therefore is also mounted within the said hermetically sealed casing. Although pump 3 in FIGS. 6-7 are shown as being submerged, the pump 3 can also be mounted such that the pump is not submerged in the liquid working fluid. By submerging the pump in the liquid working fluid, however, several benefits are realized. For instance, the pump 3 realizes a cooling effect from the liquid working fluid, does not need priming, is easily mounted in such a location, and does not require "pick-up" tubing. As also illustrated in FIGS. 6-7, the apparatus according to embodiments of the present invention can include a spent vapor guide 870 connected to a vapor outlet of the pressure motor 30. The spent vapor guide 870 channels or directs the flow of vaporized working fluid exiting the pressure motor onto the one or more conduits. As shown by FIGS. 6-7, the spent vapor guide 870 need not connect the pressure motor vapor outlet to the working vapor condensing section 850. That is, each of the sections, 600, 800, and 850 are preferably not physically separated or compartmentalized, but instead are preferably open with respect to each other. For instance, sections 600, 800 and 850 are all in fluid communication with each other and not completely separated from one another by internal walls or barriers. In such embodiments, every component (and electrical wiring within electrical conduits) of the apparatus is preferably mounted/positioned within the hermetically sealed casing. That is, with the exception of the power outlet 810 every other component can be mounted within the hermetically sealed casing.

Common safety features illustrated by FIGS. 6-7 includes a primary pressure bypass valve 830, primary internal blow-off rapid vapor cooler 815, and a secondary pressure bypass valve for atmospheric relief 820 which can be set to relieve pressure upon realization of a predetermined internal pressure threshold by the chamber pressure sensor 825.

As illustrated in FIGS. 6-7, the liquid storage section includes a cooler 620 for maintaining the temperature of the working liquid to within just a few degrees shy of its boiling point (e.g., 20, 15, 10, 5, 3, 2, or 1 degrees below the boiling point of the working fluid). FIG. 7 shows a cooling control valve 630 that can be adjusted to automatically control the temperature of the working fluid within the liquid storage section. This feature can be readily automated and while the valve positioning can be adjusted based on temperature readings or pressure sensed within the liquid storage section.

Unlike the embodiment illustrated in FIG. 6, the embodiment shown in FIG. 7 utilizes the liquid working fluid to condense the vaporized working fluid exiting the pressure motor. As such, external and costly utilities are avoided. An additional benefit realized according to this particular embodiment is that by using the liquid working fluid to condense the vaporized working fluid exiting the pressure motor, the liquid working fluid is pre-heated prior to entering the primary heat exchanger. Thus, less energy is required in the primary heat exchanger to vaporize the working fluid.

Thus, in certain embodiments according to the present invention the Organic Rankine Cycle is modified to increase the efficiency of the system. Instead of using a transfer fluid such as water or glycol mixes to run through a condenser, so as to convert the spent vapor back exiting the pressure motor to liquid form, which wastes the removed thermal energy, the cooler 620 using a cooling transfer fluid (e.g., refrigerant) in the liquid storage section 600 can be used to merely stabilize the working fluid to a temperature just cool enough to allow the working fluid to be utilized itself as the condensing fluid in conduits 855. The cooling transfer fluid is simply run through a cooler 620 that is submerged directly within the working fluid 5 in the liquid storage section 600. Because liquid is far more stable and allows for better thermal transfer than vapor, less thermal energy is required to control the temperature of the liquid working fluid 5. Also, since the working fluid is also used as the condensing fluid (i.e., transfer fluid in the condensing section), the cooling transfer fluid requires less thermal energy to control the condensing temperature and, as the vaporizing/condensing fluid passes through the working fluid vapor condensing section (e.g., condensing exchanger) and the energy/heat is exchanged, removing the heat from the vapor allowing it to re-liquefy and thus, transferring the heat from the vapor to the vaporizing working fluid in turn, pre-heating the working fluid prior to it feeding into the primary heat exchanger for vaporizing the working fluid. Since the working fluid is pre-heated, this approach utilizes less thermal energy for vaporizing of the working fluid and therefore translates to a far greater efficiency of the cycle.

In embodiments having components mounted with the hermetically sealed casing, the engineered working fluid should preferably also be non-conductive. For instance, utilizing Novec 7000 or other engineered working materials (e.g., ethers and ketones with the same low temperature vaporizing characteristics that do not conduct electrical energy), allows for a new way to create the Rankine Cycle which has benefits that are superior to the accepted forms of both the Rankine and Organic Rankine systems. Such embodiments allow for a partial and even completely hermetically sealed generator system. One benefit associated with such embodiments is that system will be contained within a module/casing for easier function and set-up. Further, these embodiments allow for both the interior and exterior of the pressure motor to be cooled as well as cooling of the electric generator itself using the spent vapor. In certain embodiments, even the boiler can optionally be enclosed within the unit with adequate insulation.

Working fluids according to certain embodiments of the present invention are preferably also non-conductive and non-flammable. Various hydrofluoroethers (HFEs) are particularly well suited for such embodiments. Such, HFEs are commercially available from 3M. One such example of a suitable HFE is the Novec 7000 fluid (and those similar thereto). This fluid is non-conductive, and hence can directly contact the electrical components of the system (such as the generator, pump, wiring and computer control module) with little or no corrosive effects. Further, the Novec 7000 fluid (and those similar thereto) will function to keep these components cooled for better operating efficiency. In other systems prior to the present invention, the electrical components are exposed to the atmosphere where they can be contaminated by rain, dust, sand, insects, etc., and/or are subjected to passive solar heating. Hence, the electrical components of the prior systems are subject to corrosive damage, over-heating and operation at less than optimal temperatures. Although Novec 7000 has been discussed in more detail, any engineered liquid having the physical properties (e.g., boiling point, non-flammable, non-conductive, preferably denser than water) described herein can be employed in certain embodiments of the present invention. For instance, Novec 649, 7100, and 1230 are also suitable for use in certain embodiments.

An additional benefit is that if the pressure motor, which is hermetically sealed within the module, begins to leak for any reason, the vapor will remain inside of the housing or casing of the system instead of being lost to the environment. Even a minor vapor leak in a traditional Organic Rankine Cycle system meant a complete shut down and repair of the system to prevent damage and, most importantly, loss of the work-vapor. To the contrary, in certain embodiments according to the present invention most of these leaks will simply lower the efficiency of the present invention. However, embodiments of the present invention can be allowed to run until a more appropriate repair time presents itself.

Embodiments according to the present invention will also provide improved drive motor and generator protection, due to the placement of these units within the housing or casing and the cooling ability of the engineered working fluid, which may optionally contact the electrical units in certain embodiments of the present invention to provide additional cooling. The added protection will equate to a longer work-life of the electrical units and more optimal performance during their work lives. The ability to work, even while a leak is present, is an economic advantage as well. Thus, hermetically sealed modular systems also lend themselves to being fabricated into a system that can add more units more effectively when the opportunity arises.

Such benefits, cannot be realized with the traditional Rankine cycle systems because, for one example, if the electronic components (e.g., generator, wiring, computer controller) were located within a housing or hermetically sealed casing, the intense heat and steam would 'short out' and deteriorate the electronics and create temperature variation issues that would be uncontrollable. The traditional ORC systems use CFCs and freons which are to be phased out or, or used solvents or gaseous fuels such as Toluene, N-Pentane, Butane or Propane, which are combustible and highly flammable and prohibit their use in combination or close proximity with electronic components capable of generating sparks and causing an explosion.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A vapor powered apparatus for generating electric power comprising:

a hermetically sealed casing;

a storage tank containing a working fluid having a boiling point of 150° F. or less;

a heating source that vaporizes at least a portion of said working fluid to provide a working pressure of the vaporized working fluid, said heating source is in fluid communication with said storage tank;

a pressure motor that converts the working pressure of the vaporized working fluid into mechanical motion, wherein said pressure motor is in fluid communication with said heat source; and a recapture system configured to capture the vaporized working fluid exiting said pressure motor, condense the vaporized working fluid, and return the condensed working fluid back to said storage tank, wherein said pressure motor is operatively connected to a power generator or alternator, and wherein each of the storage tank, heating source, pressure motor, recapture system, and power generator or alternator are mounted within said hermetically sealed casing.

2. The apparatus according to claim 1, wherein said working fluid comprises Methoxy-nonafluorobutane, $CF_3CF_2C(O)CF(CF_3)_2$, or Dodecafluoro-2-methylpentan-3-one.

3. The apparatus according to claim 1, wherein said heating source comprises a heat exchanger using ambient air as a transfer fluid for vaporizing at least a portion of the working fluid; wherein the temperature of the ambient air is greater than the boiling point of the working fluid.

4. The apparatus according to claim 1, wherein said heating source comprises a heat exchanger using a transfer fluid having a temperature of less than 150° F. for providing the heat to vaporize at least a portion of the working fluid; wherein the temperature of the transfer fluid is greater than the boiling point of the working fluid.

5. The apparatus according to claim 4, wherein the transfer fluid for providing the heat to vaporize at least a portion of the working fluid has a temperature from 90° F. to 150° F.

6. The apparatus according to claim 4, wherein the transfer fluid for providing the heat to vaporize at least a portion of the working fluid has a temperature from 93° F. to 150° F.

7. The apparatus according to claim 4, wherein the transfer fluid for providing the heat to vaporize at least a portion of the working fluid has a temperature from 100° F. to 140° F.

8. The apparatus according to claim 4, wherein the transfer fluid for providing the heat to vaporize at least a portion of the working fluid has a temperature from 90° F. to 100° F.

9. The apparatus according to claim 4, wherein the transfer fluid for providing the heat to vaporize at least a portion of the working fluid comprises waste heat from a separate power source.

10. The apparatus according to claim 1, wherein said heating source comprises a hot side of a Peltier plate and said recapture system comprises a cold side of a Peltier plate.

11. The apparatus of claim 10, wherein said pressure motor is operatively connected to a power generator or alternator that converts the mechanical motion into electric power and said Peltier plate is connected to a start-up power source comprising a battery; wherein the power generator or alternator recharges said battery.

12. The apparatus according to claim 1, wherein said pressure motor comprises a turbine.

13. The apparatus according to claim 1, wherein the power generator or alternator converts the mechanical motion into electric power.

14. The apparatus according to claim 1, wherein the working fluid has a boiling point less than 100° F.

15. The apparatus according to claim 1, wherein the working fluid has a boiling point from 90° F. to 150° F.

16. A vapor powered apparatus for generating electric power comprising:

a hermetically sealed casing;

a liquid storage section containing a working fluid in liquid form, wherein said working fluid has a boiling point less than 160° F.;

a vapor section in operative communication with said liquid storage section via one or more primary orifices;

a working fluid vapor condensing section located within said vapor section and proximate to said storage section, wherein said working fluid vapor condensing section includes one or more conduits;

a primary heat exchanger for vaporizing at least a portion of said working fluid to provide a working pressure of the vaporized working fluid, wherein said primary heat exchanger is operatively connected to said one or more conduits; and a pressure motor in fluid communication with said primary heat exchanger converts the working pressure of the vaporized working fluid into mechanical motion, wherein said vaporized working fluid exits from the pressure motor into said vapor section and condenses on outside surfaces of the one or more conduits to provide re-liquefied working fluid; said re-liquefied working fluid passes though said one or more primary orifices into the liquid storage section;

wherein said pressure motor is operatively connected to a power generator or alternator, and wherein each of the liquid storage section, the vapor section, the working fluid vapor condensing section, the primary heat exchanger, pressure motor, and the power generator or alternator are mounted within said hermetically sealed casing.

17. The apparatus according to claim 16, wherein the power generator or alternator converts the mechanical motion into electric power.

18. The apparatus according to claim 17, further comprising a pump that conveys working fluid from the liquid storage section through the one or more conduits and into the primary heat exchanger, wherein said pump is located within said hermetically sealed casing.

19. The apparatus according to claim 18, wherein the pump is submerged in the working fluid in liquid form located in the liquid storage section.

20. The apparatus according to claim 16, further comprising a spent vapor guide connected to a vapor outlet of the pressure motor, wherein said spent vapor guide channels vaporized working fluid exiting the pressure motor onto the one or more conduits.

21. The apparatus according to claim 16, wherein a transfer fluid having a temperature less than 160° F. is utilized for providing the heat to vaporize at least a portion of the working fluid in the primary heat exchanger, wherein the temperature of the transfer fluid is greater than the boiling point of the working fluid.

22. The apparatus according to claim 16, further comprising a pump that conveys working fluid from the liquid storage section through the one or more conduits and into the primary heat exchanger, wherein said pump is located within said hermetically sealed casing.

23. The apparatus according to claim 22, wherein the pump is submerged in the working fluid in liquid form located in the liquid storage section.

* * * * *